US005918331A

United States Patent [19]

Hall et al.

[11] Patent Number: 5,918,331

[45] Date of Patent: Jul. 6, 1999

[54] PORTABLE INTENSIVE CARE UNIT WITH MEDICAL EQUIPMENT

[75] Inventors: David Hall; John Charles Grant-Thomson, both of Queensland, Australia

[73] Assignee: Buchanan Aircraft Corporation Limited, Queensland, Australia

[21] Appl. No.: 08/776,855

[22] PCT Filed: Aug. 7, 1995

[86] PCT No.: PCT/AU95/00477

§ 371 Date: Feb. 3, 1997

§ 102(e) Date: Feb. 3, 1997

[87] PCT Pub. No.: WO96/03955

PCT Pub. Date: Feb. 15, 1996

[30] Foreign Application Priority Data

Aug. 5, 1994 [AU] Australia ..... PM7316

[51] Int. Cl.[6] ..... A61G 1/00; A61G 1/04

[52] U.S. Cl. ..... 5/626; 5/503.1; 5/658; 296/20

[58] Field of Search ..... 5/626, 625, 658, 5/503.1, 507.1; 128/875, 876, 869, 870; 296/20

[56] References Cited

U.S. PATENT DOCUMENTS

| | | | |
|---|---|---|---|
| 3,304,116 | 2/1967 | Stryker . | |
| 3,761,968 | 10/1973 | Besler . | |
| 3,877,427 | 4/1975 | Alexeev et al. | 5/629 |
| 4,224,936 | 9/1980 | Cox | 5/626 |
| 4,352,991 | 10/1982 | Kaufman . | |
| 4,584,989 | 4/1986 | Stith . | |
| 4,691,397 | 9/1987 | Netzer . | |
| 4,757,811 | 7/1988 | Clark . | |
| 4,768,241 | 9/1988 | Beney | 5/658 |
| 4,957,121 | 9/1990 | Icenogle et al. | 5/600 |
| 5,446,934 | 9/1995 | Frazier | 5/658 |

FOREIGN PATENT DOCUMENTS

| | | | |
|---|---|---|---|
| 334124 | 9/1967 | Canada . | |
| 1118819 | 2/1982 | Canada | 5/626 |
| 343077A1 | 11/1989 | European Pat. Off. . | |
| 1416697A1 | 12/1975 | United Kingdom . | |
| 1473862A1 | 5/1977 | United Kingdom . | |

*Primary Examiner*—Alex Grosz
*Attorney, Agent, or Firm*—Helfgott & Karas, P.C.

[57] ABSTRACT

A stretcher style mobile intensive care unit including an elongated hollow housing having an upper patient support table. The housing being adapted to hold at a location below the support table, a range of medical equipment. The range of medical equipment being customarily required for emergency care. The unit has four handles so that it is able to be carried like a stretcher.

38 Claims, 9 Drawing Sheets

PORTABLE INTENSIVE CARE UNIT WITH MEDICAL EQUIPMENT

FIELD OF THE INVENTION

THIS INVENTION relates to a portable intensive care unit and in particular but not limited to a stretcher style mobile intensive care unit for field use.

BACKGROUND ART

The present invention has particular application on premises or sites of operations to provide easy access to a fully equipped life support facility that can be quickly transported by road or air to further services that can provide the ongoing long-term treatment required so that the present invention can be easily returned to the site and partake in further rescue activities. This in turn enables the patient to not only receive emergency medical treatment at the point of accident (where a lack of treatment or suitable equipment may complicate their condition), but will most definitely enhance their recovery for having been treated so quickly and effectively.

Prior art solutions are generally unsatisfactory. One solution involves a so called stretcher bridge which holds instruments and straddles a stretcher, thereby bridging over the patient. While this unit has relatively low cost, equipment is exposed to the elements, patient access is restricted, the unit is relatively fragile and because of its small size, is not a fully self-contained unit. The unit lacks oxygen supply or power supply back-up. In addition, the unit does not satisfy air worthiness requirements.

Another unit of Israeli origin provides a single enclosure mounted to the rear wall of an aircraft to provide a flight surgeon with a full range of intensive care equipment. However, unfortunately, this system is not portable.

It is an object of the present invention to provide an alternative system which alleviates the aforementioned disadvantages of the prior art.

OUTLINE OF THE INVENTION

In one aspect therefore, the present invention resides in a mobile intensive care unit comprising an elongate, hollow housing having an upper patient support table, the housing being adapted to hold at a location below the support table, a range of medical equipment customarily required for emergency care. Typically the equipment is arranged in side-by-side position and the unit has handles so that the unit can be carried like a stretcher.

The housing is preferably made from a fibre reinforced resin and preferably carbon fibre is employed as this provides strength, but also reduces radiant interference from electrical equipment housed in the unit. The use of carbon fibre also enables the housing to be thin walled whilst retaining impact resistance.

The housing is preferably internally braced. Advantageously, the housing includes an outer side wall bridging between the support table and a bottom wall, the housing has at least two transverse bracing walls, one adjacent each end of the housing, the bracing walls being interconnected by a third longitudinally extending bracing wall generally centrally disposed in the housing. The walls typically have an average wall thickness of 1 to 3 mm, but where necessary, the walls are locally strengthened particularly in areas prone to concentrated load, for example, handles or tie down sites etc. The carbon fibres are preferably laid in layers at plus or minus forty-five degrees to improve loading characteristics.

The medical equipment is typically located side-by-side on one side of the central wall so that medical personnel need only operate from one side of the unit. The other side of the central wall is typically used for storage. Oxygen bottles are typically located at opposite ends of the unit and away from the medical equipment.

The support table can be flat, but can be channel-like or recessed. Typically, the support table is designed to mount a stretcher, the support table having four stretcher feet sockets and transverse slots extended between adjacent sockets for receiving transverse stretcher braces.

The housing is typically divided into a plurality of isolated medical equipment holders including a defibrillator holder having a drawer so that a defibrillator can be easily removed from the unit for emergency use.

The housing is preferably generally symmetrical in side view so that it is balanced. The unit typically includes a central cavity of generally rectangular shape and has tapered ends extending on opposite ends of the generally rectangular cavity. The central cavity typically has a sliding door.

The housing is preferably designed so that it can be carried in an aircraft with at least four locally strengthened and evenly spaced securing points and most preferably eight securing points are used so that the unit can be either tied down or hung in stackable fashion with other similar units.

The housing preferably includes lock down means provided in an underside of the housing so that the unit can be secured to a surface such as the floor of an ambulance. The lock down means typically comprises a pair of skids or rails extending along the underside of the housing. The skids or rails typically provide added structural strength to the unit and are preferably equipped with spaced apertures so that a strap or other means can pass through the apertures to lock the unit in place.

The housing is preferably equipped with brackets, holders or independent locating sites for the medical equipment so that the medical equipment is rigidly stowed yet removably secured in the housing.

The housing preferably includes a door or doors providing protection for the medical equipment from the elements or other contamination. One door is typically a vertically moveable curtain. The curtain is typically open in its lowered position. The medical equipment holders are preferably arranged so that the medical equipment is set back from the door to further limit contamination when the door is open.

Each item of medical equipment is preferably standard, off the shelf equipment and, of course, each item of medical equipment normally has its own power requirements. In this sense, each piece of equipment is isolated within the unit. Most preferably however, the unit employs a power supply conditioner through which power is supplied, firstly to the unit and then to each item of medical equipment. The power supply conditioner preferably has a supply inlet for connection to mains or any other external power source, an input circuit receiving current from the external source, a power supply conditioner circuit and a DC output circuit providing a conditioned DC output to the medical equipment. In a most preferred form, the supply inlet is adapted to receive any one of normally available AC or DC supplies, the conditioned supply at the output being isolated from fluctuations at the input to provide a standard DC voltage to the medical equipment. Typically, the defibrillator is not connected to the power supply, but is solely supplied by its own battery and is therefore isolated from the power supply conditioner. Preferably, the power supply conditioner is located adjacent a vent in the housing to cater for variations in pressure within an aircraft cabin.

The unit preferably includes an oxygen supply circuit as well as the various power supply circuits and an electrical circuit leading from the power supply conditioner to the medical equipment, the oxygen supply circuit and the electrical circuit are preferably arranged so that oxygen supply lines and electrical cables are carried on either side of a dividing wall for safety purposes. The oxygen supply circuit preferably includes at least two oxygen bottles and a pneumatic circuit with oxygen supply selection means enabling selection of either of the two bottles or an external supply.

BRIEF DESCRIPTION OF THE DRAWINGS

In order that the invention can be more readily understood and be put into practical effect, reference will now be made to the accompanying drawings which illustrate a preferred embodiment of the present invention and wherein:FIG.

METHOD OF PERFORMANCE

Figure 1:
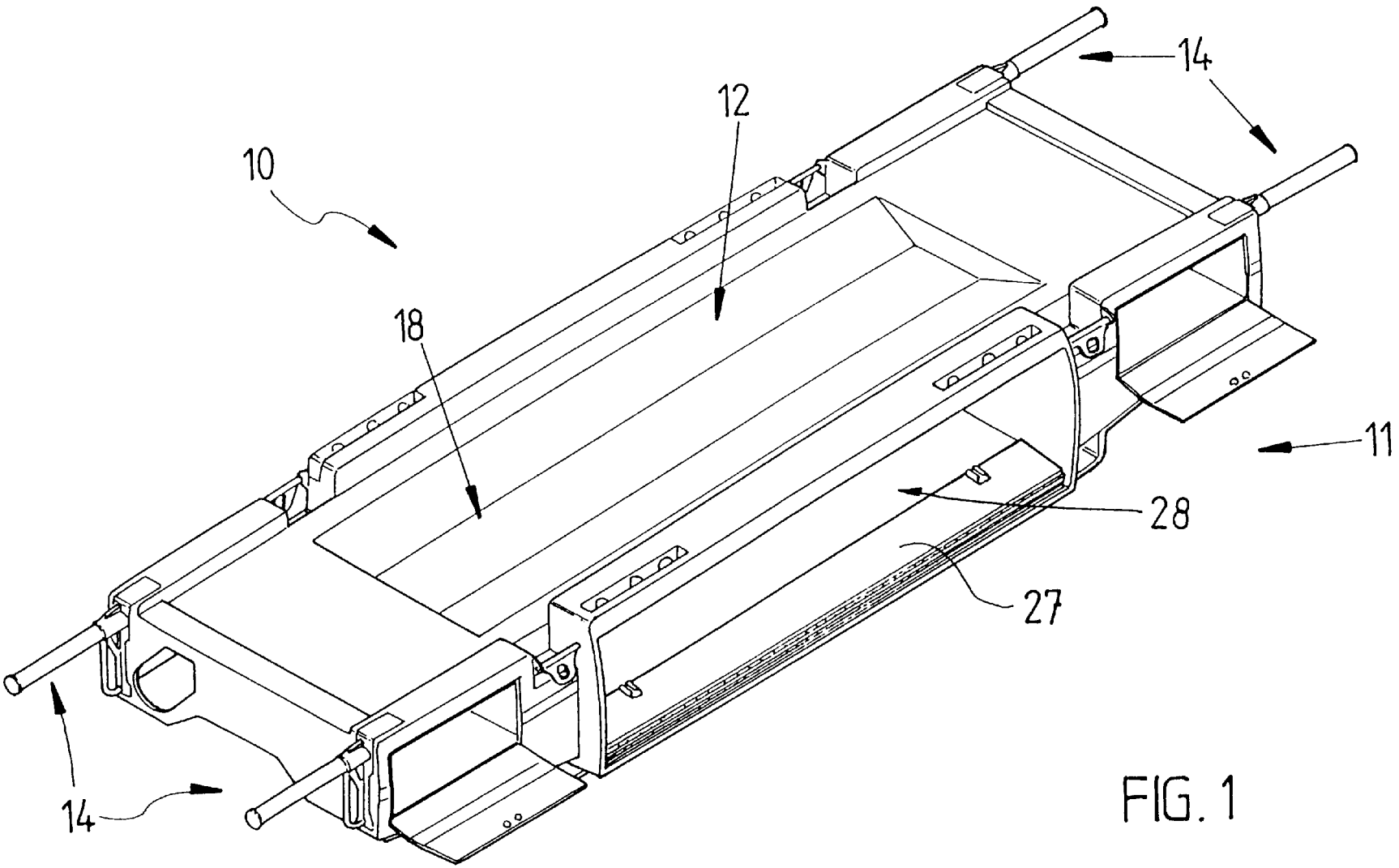
FIG. 1 is a perspective view of a portable intensive care unit according to the present invention with the medical equipment removed.

Referring to the drawings and initially to FIGS. 1 to 6, there is illustrated a stretcher style mobile intensive care unit 10 comprising an elongate hollow housing 11 having an upper patient support table 12, the housing being adapted to hold at a location below the support table 12, a range of medical equipment. The range is shown generally at 13 and being customarily equipment required for emergency care. The unit has, in this case, four handles 14 so that the unit can be carried like a stretcher.

The unit carries its own 880 liter capacity oxygen supply in 2 "C" size cylinders connected to a common manifold via a change over switch. A connection to an external oxygen supply is also available. Alarms are used to indicate a failing supply. The oxygen can be used for ventilation via a ventilation unit or for variable rates of supply via a standard oxygen mask. A patient over or under pressure electronic alarm system, which is operator adjusted is also fitted, thus providing continuous monitoring of the patients breathing circuit.

Power for all the electromedical equipment is provided by an internal power unit including a rechargeable 12 volt battery bus supported by a conditioner to regulate supply to the battery and/or the electromedical equipment so that the bus may be connected via the conditioner to almost any available source of external power. Typical external power sources that are usually available and are compatible include a road vehicle 12V D.C. supply, an aircraft 28V D.C. supply any alternating current source between 80 to 250 vac at any frequency from 50 to 400 Hz.

The unit typically holds for use six pieces of medical equipment.

A multifunction monitor is fitted capable of providing electrocardiogram, heart rate, non-invasive blood pressure, invasive blood pressure, pulse oximetry, and temperature measurement all through appropriate transducers.

A ventilator is fitted with infinitely adjustable respiratory frequency (approx. 10 to 30 breaths per minute) and minute volume (approx. 2 to 20 liters per minute) settings.

The capability of selecting either 100% oxygen or an oxygen/air mixture without changing minute volume is also available.

A demand valve and mask is also fitted together with pre-settable oxygen therapy and face mask.

A breathing circuit disconnect alarm unit is included such that the operator may select both high and low pressure alarm indications.

An electric volumetric infusion pump is fitted having adjustable infusion rates up to 999 ml/hr increments.

A syringe pump is fitted for continuous micro infusion. The unit accepts 50 ml syringes and has adjustable flow rates up to 150 ml/hr in 0.1 ml/hr increments.

An electric compact suction unit is fitted having adjustable vacuum levels from 200 to 500 mmHg.

A Defibrillator is fitted which can also act as an ECG monitor. The unit monitors ECG and chest impedance prior to arming itself for shock delivery.

A portable anaesthetic machine can be temporarily attached to the unit for field surgical procedures.

Consideration in designing the unit has been given to its use not only in tactical and strategic AME situations in both fixed and rotary wing aircraft, but also in field ambulances, field and general hospitals, mobile field surgical teams and the parachute surgical team.

Figure 2:
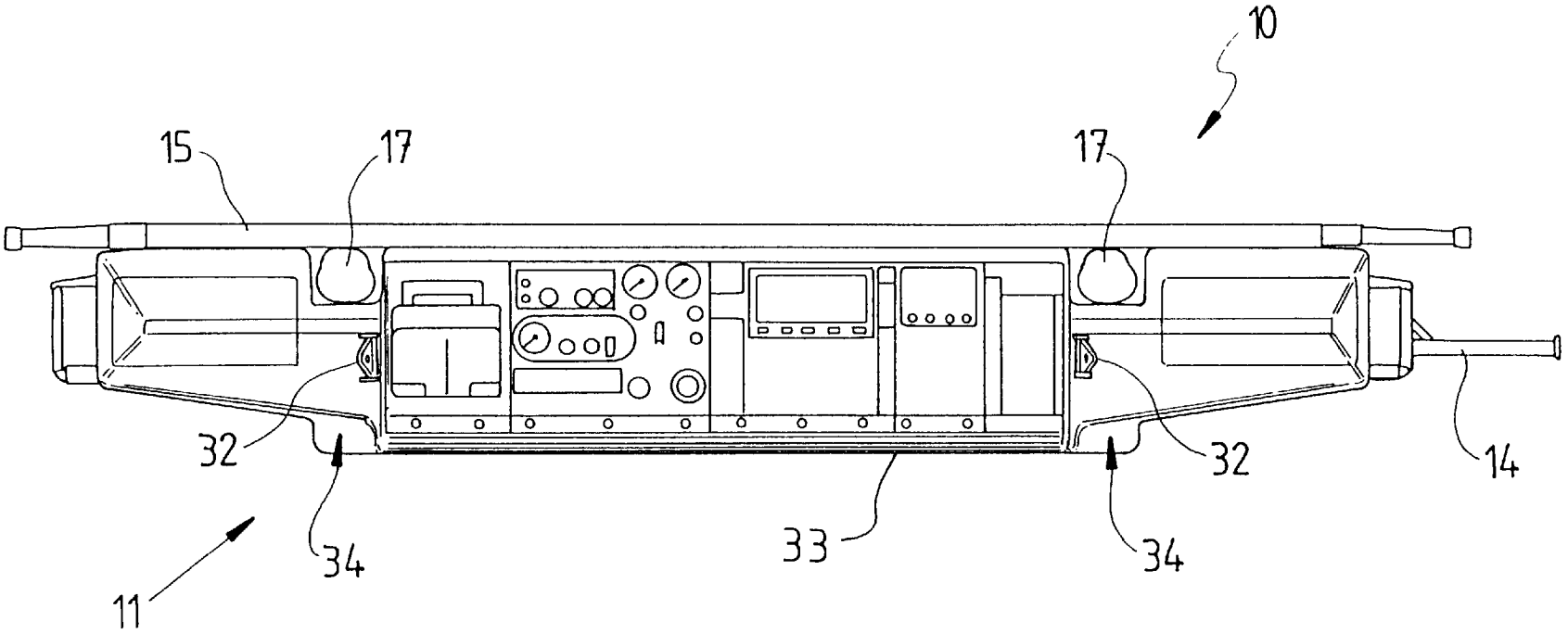
FIG. 2 is a side view of a stretcher style mobile intensive care unit according to the present invention.
Figure 3:
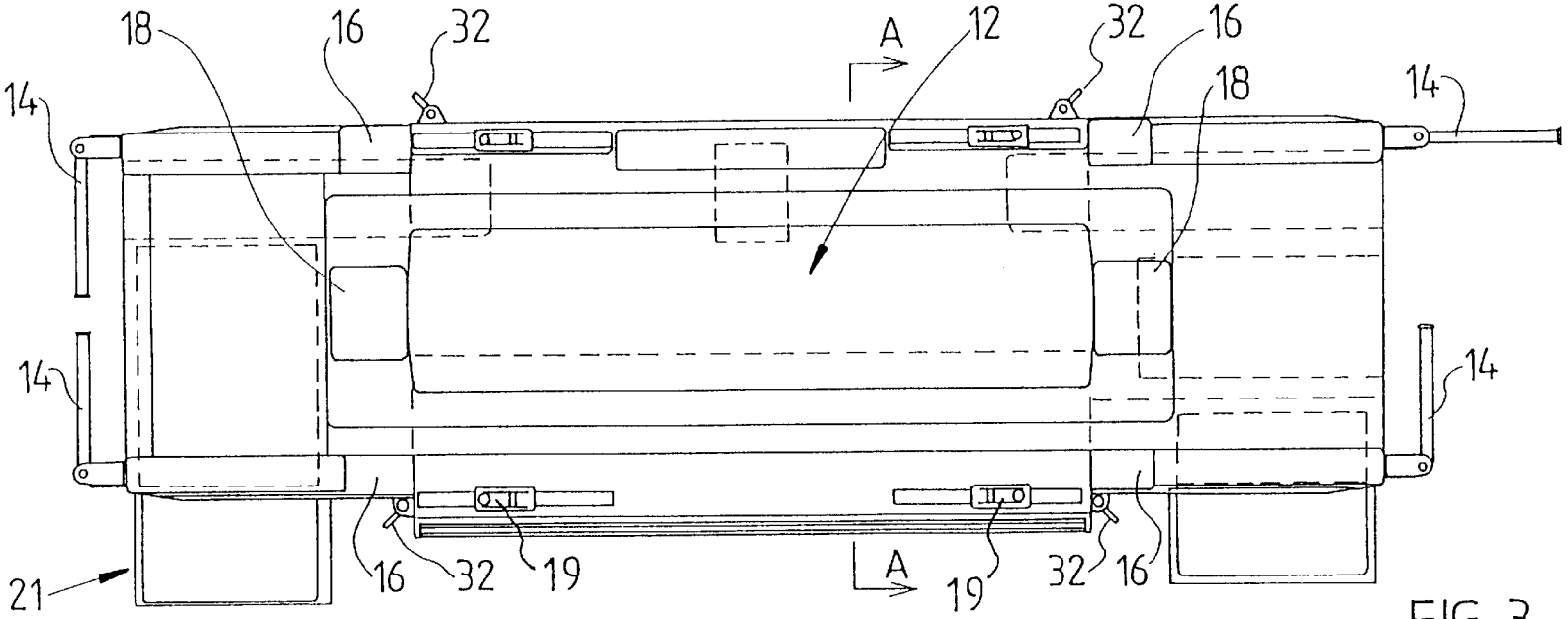
FIG. 3 is a plan view of the unit of FIG. 1.

In one application of the invention, as illustrated in FIG. 2, a standard NATO styled stretcher 15 (in phantom in FIGS. 3, 4 and 5) is shown located on and above the patient support table 12, the stretcher being located in place by sockets 16 into which the feet 17 of the stretcher 12 automatically locate. In the case of the NATO styled stretcher, an arcuate brace extends down from the stretcher at about the level of the feet 17 and extends transversely across the stretcher. The patient support table 12 includes transverse recesses 18 to take into account this brace. The patient support table 12 is generally recessed and includes adjustable eyelets 19 on sides thereof which can be moved longitudinally along the unit for the purpose of providing sites for straps to secure a patient and therefore the stretcher in place.

It will be appreciated however, that the support table can be configured to carry any suitable stretcher or any other patient support.

In the illustrated embodiment, the items of medical equipment include a defibrillator held at 20 on a sliding carriage or drawer 21, the defibrillator being isolated from the other medical equipment, a suction unit at 22, a ventilator and oxygen module at 23, a multi-function monitor at 24, a volume infusion pump at 25 for parenteral fluids and a syringe infusion pump at 26. All of the medical equipment is accessible from one side of the unit and the opposite side of the unit includes doors for access to the interior for storage purposes. A sliding curtain 27 is used to cover the medical equipment housed in the generally rectangular cavity 28. The front faces of the medical equipment are generally recessed back from the curtain 27 to limit contamination. The defibrillator and the syringe infusion pump are located behind hinged doors. The whole unit can therefore be closed for transportation purposes.

The unit is balanced by virtue of the arrangement of compartments and components within the unit and the generally symmetrical stretcher style arrangement of the unit. The unit can be comfortably handled by four people when loaded with a patient and can be carried in the fashion of a suitcase when unloaded.

Figure 4:
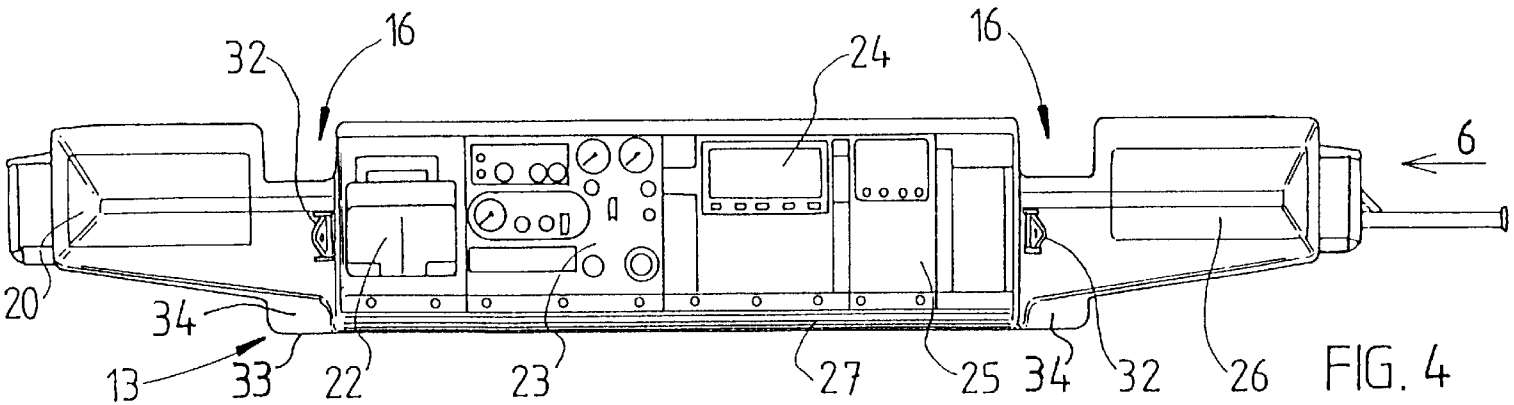
FIG. 4 is side view similar to that of FIG. 1.
Figure 5:
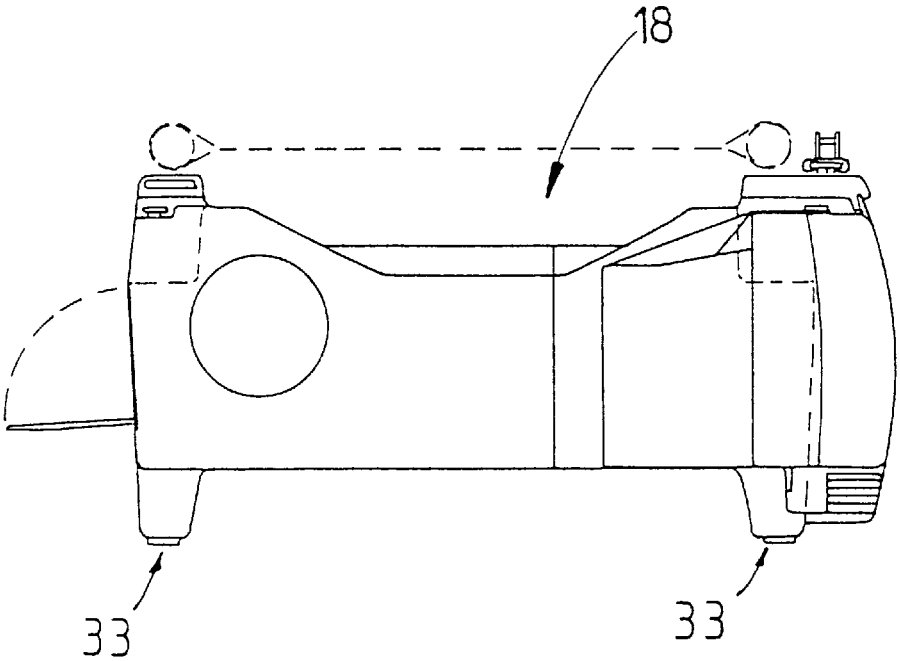
FIG. 5 is a section through A—A of FIGS. 2 and 3.
Figure 6:
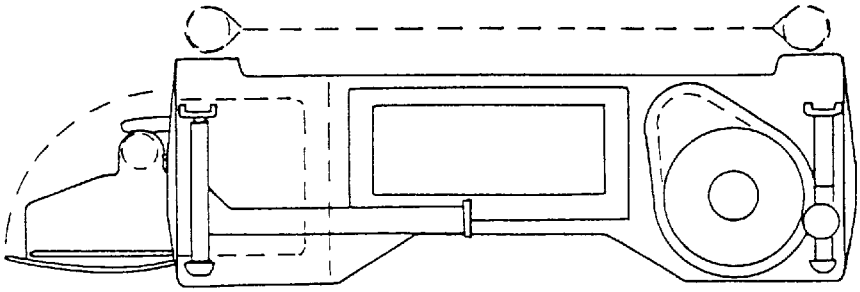
FIG. 6 is an end view.

In FIGS. 2, 4 and 5 the unit includes a pair of spaced rails 33 having apertures 34 so that the unit can slide into an ambulance and be locked in place adjacent the standard rails inside the ambulance. A locking means such as a strap or the like is generally used and is inserted through the apertures 34 for this purpose.

Figure 7:
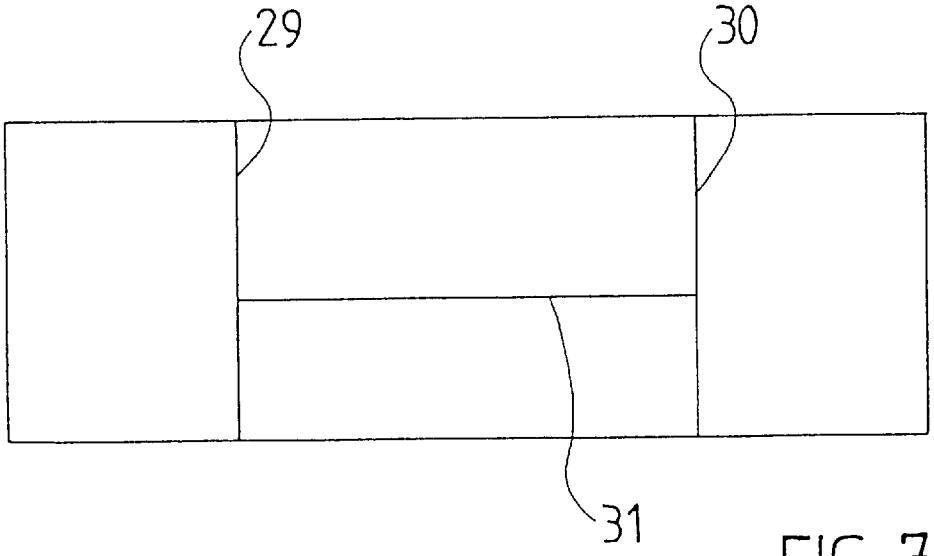
FIG. 7 is a general layout schematic illustrating main structural features of the unit.

The general structural layout is shown in FIG. 7 in a schematic form where two walls 29 and 30 extend transversely across the unit adjacent opposite ends of the unit. A longitudinally extending wall 31 bridges between the walls 29 and 30 thereby providing structural integrity for the unit. The unit is made from carbon fibre reinforced resin, it has an average wall thickness of around 2 to 3 mm with the wall being structurally thickened and stronger at the handles 14 and at tie down sites 32 (see FIGS. 1, 2 and 3), can either be tied down or he unit can either be tied down or can be hung via the handles 14 and their mountings to the unit. It is most typically hung and stacked in hung positions at various heights when being transported by aircraft. In the illustrated embodiment therefore, there are eight securing sites for securing the unit in the aircraft or in other transportation means.

Figure 8:
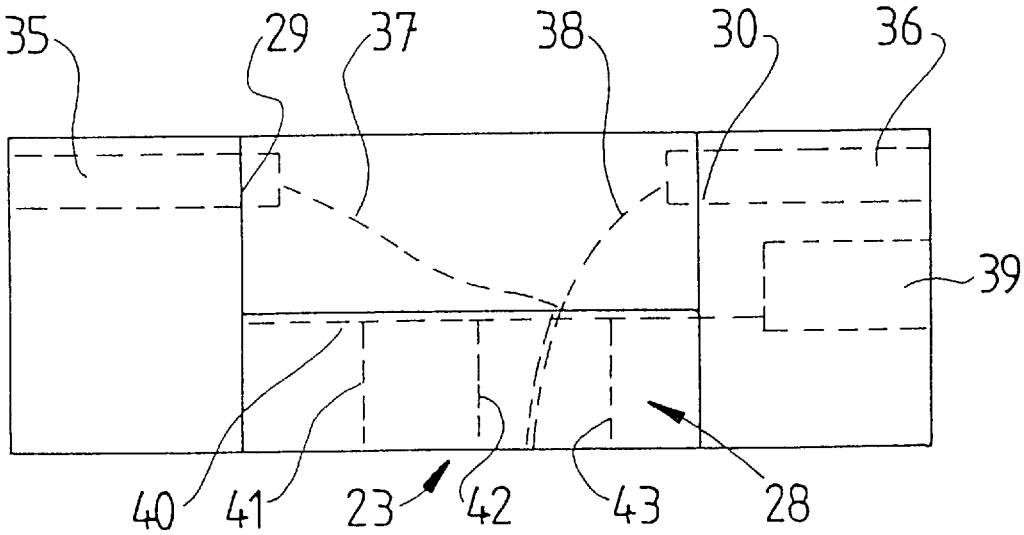
FIG. 8 is a general layout schematic showing the relative positions of a typical oxygen circuit and a typical electrical circuit.

Referring now to FIG. 8, there is illustrated in schematic form the oxygen and electrical layout of the unit and, in this case, a pair of oxygen bottles 35 and 36 are employed with high pressure lines 37 and 38 leading to the ventilator and oxygen control module shown generally at 23, the unit is provided with a power conditioner at 39 and this has a cable at 40 communicating with each item of electric equipment located in the rectangular cavity shown generally at 28. Associated with each item of equipment is a wall or bracket or a separate container which is shown schematically by the dotted lines at 41, 42 and 43, these enable the items of medical equipment to be rigidly secured in the cavity 28, but still be removable and interchangeable, for example, the units may need to be removed and interchanged for cleaning purposes. The electrical cable 40 has separate independent connectors for each item of equipment.

Figure 9:
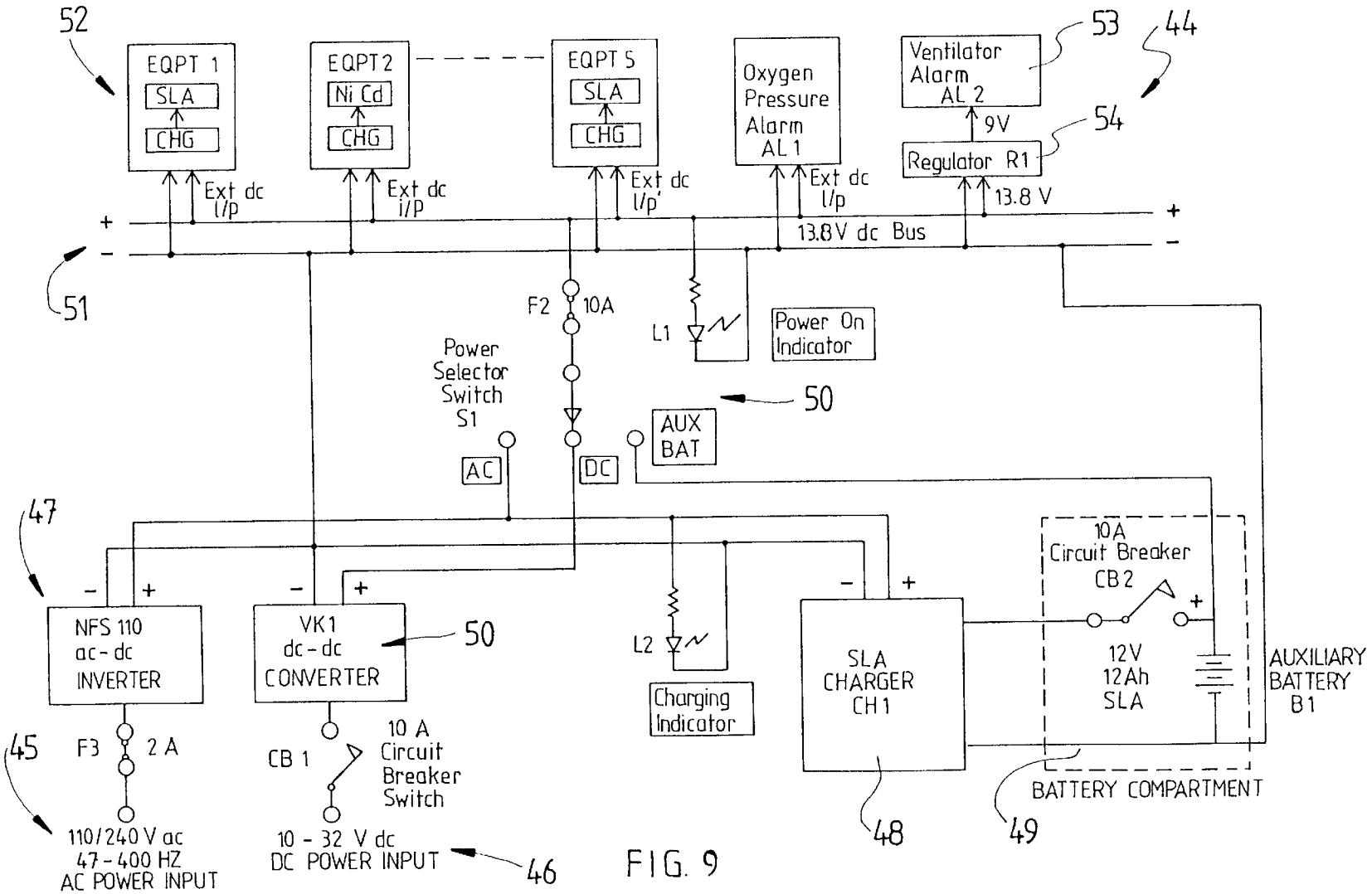
FIG. 9 is a block diagram of a power conditioner suitable for the present invention.

Referring now to FIG. 9, there is illustrated a typical conditioner circuit 44 employing an AC power input at 45 and a DC power input at 46. The AC input is arranged to generally accept voltages from 80 to 240 volts AC and at a frequency from 47 Hz to 400 Hz, while the DC input accepts voltages in the range of 8 to 32 volts DC. A proprietary AC to DC inverter 47 and a proprietary DC to DC converter 50 supplies power to the proprietary battery charger 48 to charge an auxiliary battery 49.

The unit is equipped with a power selector switch shown generally at 50, which enables a user to either select AC input or DC input or power from the auxiliary back-up battery 49, the outcome being the delivery of a steady 13.8 volts DC to the medical units supplied at 51. Each of the medical units is shown generally at 52 connected to the bus 51. As mentioned previously, each of the medical units has its own battery supply and charging capability, so when AC or DC input power is connected to 45 or 46, the auxiliary battery is charged and each of the batteries of the corresponding medical equipment are also charged. In the present case, a 9 volt DC supply is required for the nominally selected ventilator alarm at 53 and a voltage regulator 54 is provided on the bus to account for this.

Figure 10A:
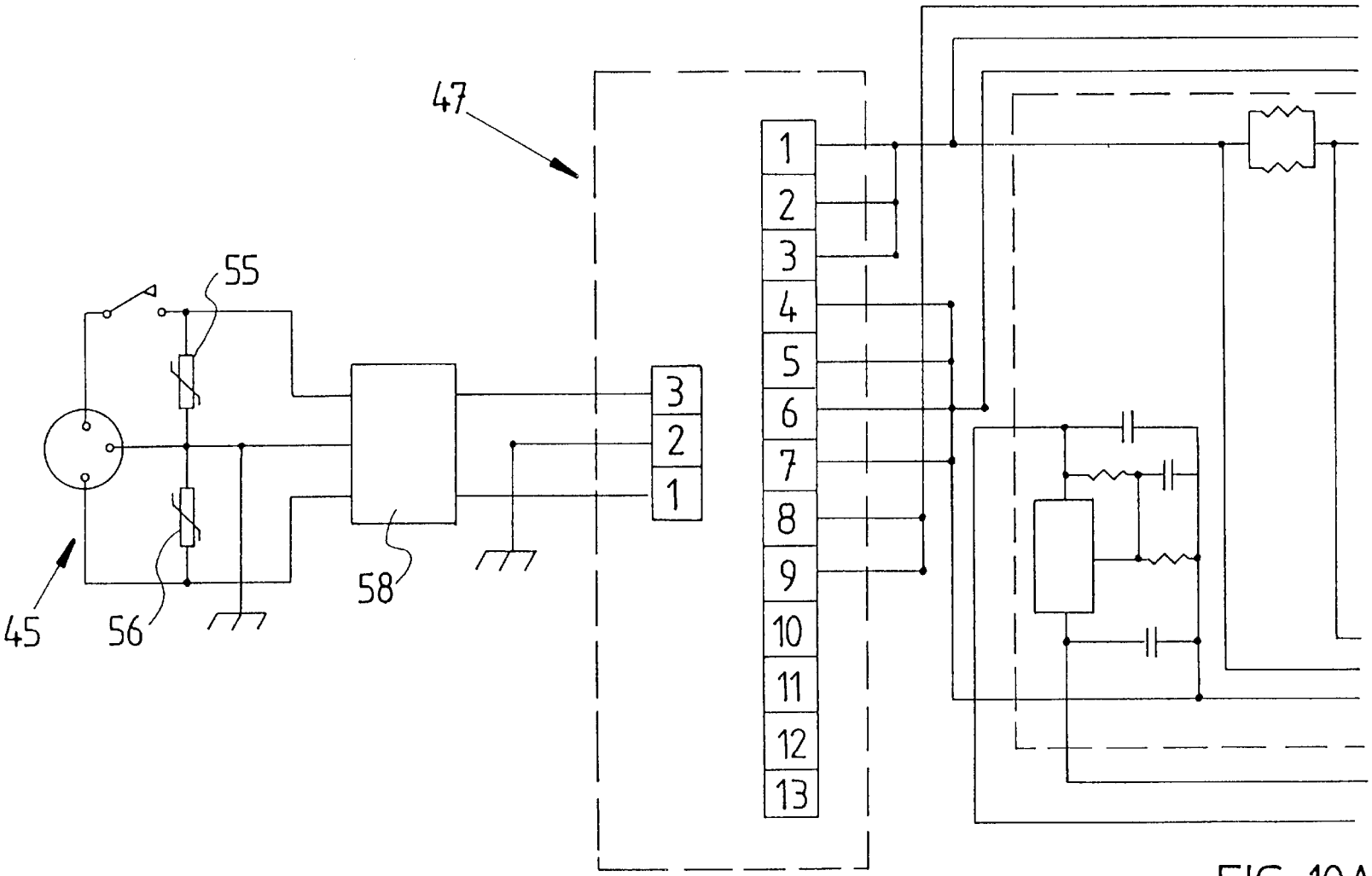
FIGS. 10A and 10B make up a circuit diagram illustrating a typical circuit for implementation of the power conditioner aspect of the present invention.
Figure 10B:
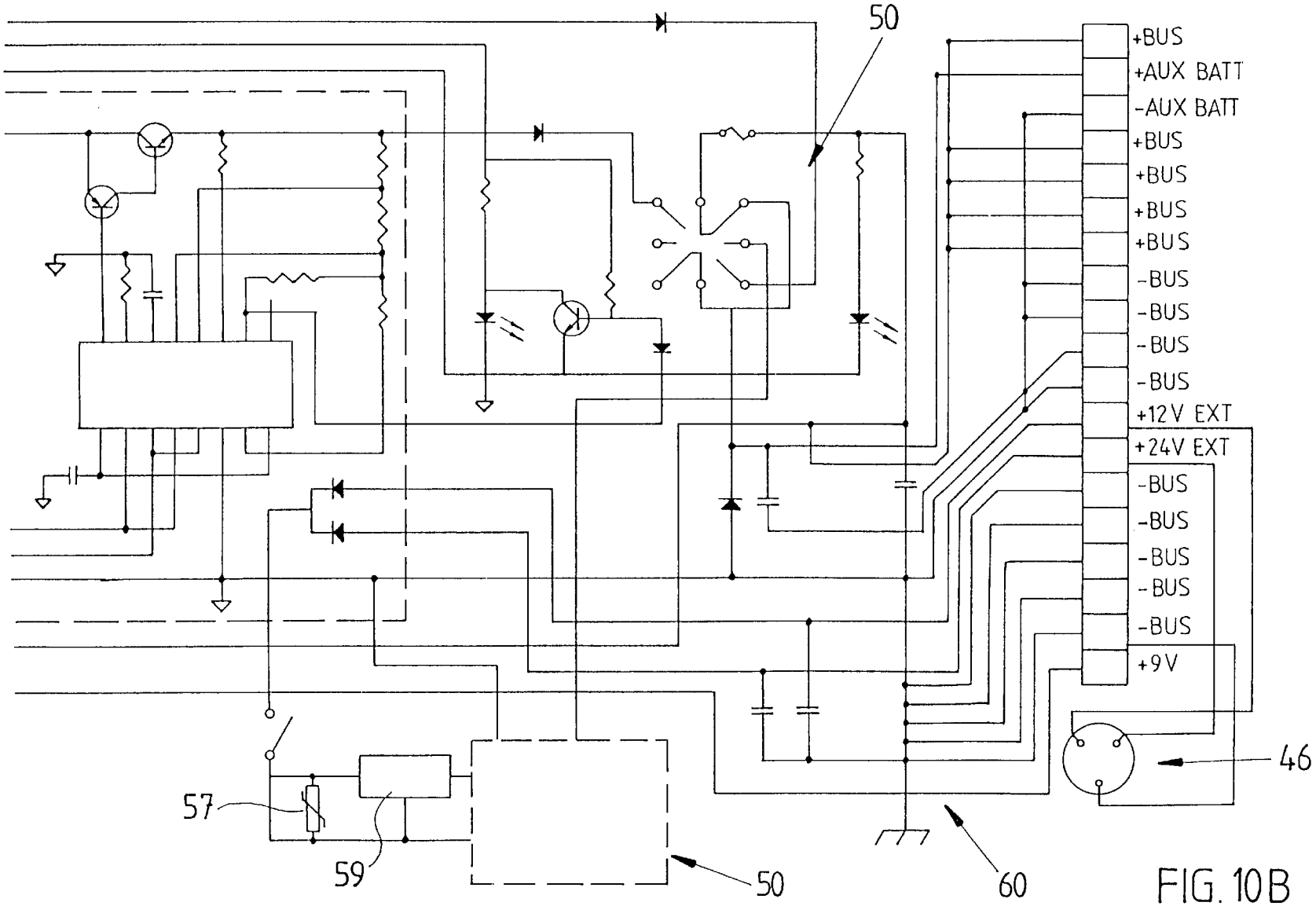

A more detailed circuit is illustrated in FIGS. 10A, 10B and where appropriate, like numerals have been used to illustrate like features with the significant additional variations being the inclusion of varistors at 55, 56 and 57 to inhibit susceptibility interference, filters at 58 and 59 to prevent conducted emissions and high frequency filtration at 59 to prevent interference with aircraft avionics equipment. The whole circuit is located within a faraday cage to prevent radiated interference and as the housing itself is also made from a carbon fibre reinforced resin, this provides additional shielding.

Figure 11:
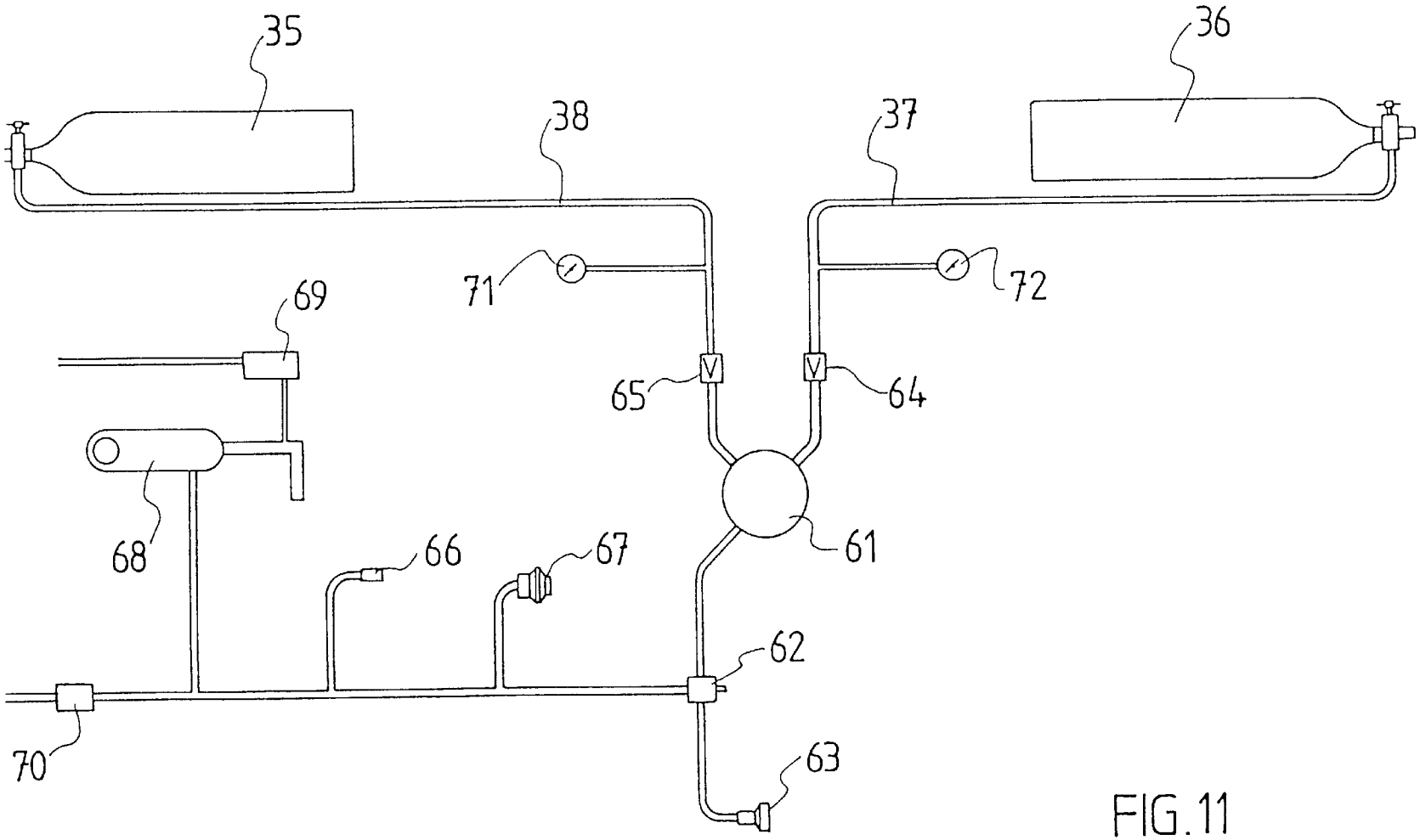
FIG. 11 is a general layout diagram of a preferred oxygen supply circuit.

Referring now to FIG. 11, there is illustrated, a typical pneumatic circuit involving the two gas bottles 35 and 36 and high pressure lines 37 and 38 which communicate with a regulator at 61 and in turn with a source selector valve 62. The source selector valve 62 enables selection of an external oxygen source supplied via fitting 63 or the internal source from bottles 35 and 36. Non return valves 64 and 65 enable the bottles 35 and 36 to independently be exchanged for a fresh supply.

Item 66 is a demand valve and item 69 is an outlet for oxygen therapy purposes. Oxygen is supplied to the ventilator unit 68 which is part of the oxygen module 23. This is also equipped with an oxygen disconnect alarm at 69. Supply pressure warning gauges 71 and 72 are provided for checking the contents of the bottles 35 and 36.

Whilst the above has been given by way of illustrative example of the present invention, many variations and modifications thereto will be apparent to those skilled in the art without departing from the broad ambit and scope of the invention as set forth in the appended claims.

We claim:

1. A manually portable intensive care unit comprising an elongated hollow housing having an upper patient support table and a lower medical equipment enclosure extending below the support table provided internally thereof with compartments containing medical equipment, the housing being of shallow profile and lightweight impact resistant construction and the medical equipment being positioned therein to provide a generally balanced assembly suitable for manually bearing an adult patient in a prone position on the support table, wherein the housing includes lock down means provided in an underside of the housing so that the unit can be secured to a surface such as a floor of an ambulance, wherein the lock down means comprises a pair of skids or rails extending along the underside of the housing and being equipped with spaced apertures so that a strap or other means can pass through the apertures to lock the unit in place.

2. A manually portable intensive care unit comprising an elongated hollow housing having an upper patient support table and a lower medical equipment enclosure extending below the support table provided internally thereof with compartments containing medical equipment, the housing being of shallow profile and lightweight impact resistant construction and the medical equipment being positioned therein to provide a generally balanced assembly suitable for manually bearing an adult patient in a prone position on the support table, which further includes a power supply conditioner for supplying power to the equipment, firstly to the unit and then to each item of medical equipment, the power supply conditioner having a supply inlet for connection to mains or any other external power source, an input circuit receiving current from the external source, a power supply conditioner circuit and a DC output circuit providing a conditioned DC output to the medical equipment.

3. The unit according to claim 2 wherein the supply inlet is adapted to receive any one of normally available AC or DC supplies, the conditioned supply at the output being isolated from fluctuations at the input to provide a required standard DC voltage to the medical equipment.

4. The unit according to claim 2 further including a defibrillator that includes a battery enabling the defibrillator not to be connected to the power supply and isolated from the power supply conditioner.

5. The unit according to claim 4 wherein the power supply conditioner is located adjacent to a vent in the housing to compensate for variations in pressure within an aircraft cabin.

6. A self contained portable intensive care unit having medical equipment including an on board ventilator, suction unit, oxygen supply and internal power supply located within a closed elongated housing, the housing having an elongated upper patient support table and being adapted for military field use, wherein the patient support platform supports a standard NATO styled stretcher above the patient support table, the housing including spaced sockets to automatically locate the stretcher and the table having spaced transverse recesses accommodating transverse braces on the NATO styled stretcher.

7. The unit according to claim 6 wherein the housing is reinforced by carbon fibers arranged in layers at plus or minus fifty-five degrees to improve loading characteristics.

8. A self contained portable intensive care unit having medical equipment including an on board ventilator, suction unit, oxygen supply and internal power supply located within a closed elongated housing, the housing having an elongated upper patient support table and being adapted for military field use, wherein the housing includes an outer side wall bridging between the support table and a bottom wall, the housing has at least two transverse bracing walls adjacent at each end of the housing, the bracing walls being interconnected by a third longitudinally extending bracing wall generally centrally disposed in the housing.

9. A self contained portable intensive care unit having medical equipment including an on board ventilator, suction unit, oxygen supply and internal power supply located within a closed elongated housing, the housing having an elongated upper patient support table and being adapted for military field use, wherein the medical equipment is located side-by-side on one side of a central bracing wall so that medical personnel need only operate from one side of the unit.

10. A self contained portable intensive care unit having medical equipment including an on board ventilator, suction unit, oxygen supply and internal power supply located within a closed elongated housing, the housing having an elongated upper patient support table and being adapted for military field use, wherein the support table is configured to support a stretcher, the support table having four stretcher feet sockets and transverse slots extending between adjacent sockets for receiving transverse stretcher braces.

11. A self contained portable intensive care unit having medical equipment including an on board ventilator, suction unit, oxygen supply and internal power supply located within a closed elongated housing, the housing having an elongated upper patient support table and being adapted for military field use, wherein the housing includes lock down means provided in an underside of the housing enabling the unit to be secured to a surface such as the floor of an ambulance, wherein the lock down means includes a pair of skids or rails extending along the underside of the housing and being equipped with spaced apertures so that a strap or other means can pass through the apertures to lock the unit in place.

12. A self contained portable intensive care unit having medical equipment including an on board ventilator, suction unit, oxygen supply and internal power supply located within a closed elongated housing, the housing having an elongated upper patient support table and being adapted for military field use, wherein the housing includes at least one door or curtain disposed over and providing protection for the medical equipment from the elements, the medical equipment being held in holders arranged so that the medical equipment is set back from the door or curtain to further limit contamination when the door or curtain is open.

13. A self contained portable intensive care unit having medical equipment including an on board ventilator, suction unit, oxygen supply and internal power supply located within a closed elongated housing, the housing having an elongated upper patient support table and being adapted for military field use, wherein the internal power supply employs a power supply conditioner for supplying power firstly to the unit and then to each item of medical equipment, the power supply conditioner having a supply inlet for connection to mains or any other external power source, an input circuit receiving current from the external source, a power supply conditioner circuit and a DC output circuit providing a conditioned DC output to the medical equipment.

14. The unit according to claim 13 wherein the supply inlet is adapted to receive any one of normally available AC or DC supplies, the conditioned supply at the output being isolated from fluctuations at the input to provide a standard DC voltage to the medical equipment.

15. The unit according to claim 13 which further includes a defibrillator having a battery enabling the defibrillator not to be connected to the power supply and isolated from the power supply conditioner.

16. The unit according to claim 13 wherein the power supply conditioner is located adjacent to a vent in the housing to compensate for variations in pressure within an aircraft cabin.

17. A self contained portable intensive care unit having medical equipment including an on board ventilator, suction unit, oxygen supply and internal power supply located within a closed elongated housing, the housing having an elongated upper patient support table and being adapted for military field use, an oxygen supply circuit as well as various power supply circuits and an electrical circuit leading from the power supply to the medical equipment, the oxygen supply circuit and the electrical circuit being arranged so that oxygen supply lines and electrical cables are carried on either side of a dividing wall for safety purposes.

18. A mobile portable intensive care unit for use in an evacuation environment where a patient is being rescued including a military operation in a combat environment, the unit comprising a shallow elongated housing having opposite ends and an upper surface, the opposite ends having respective handles enabling the unit to be carried similar to a stretcher, the housing holding a range of life support medical equipment in a weight-wise balanced configuration within the housing to facilitate manual handling of the unit, the upper surface having a removable stretcher for carrying a patient, the removable stretcher and the upper surface of the housing having co-operating means for holding the stretcher in an operative position on the upper surface of the housing.

19. The unit according to claim 18 wherein the housing is reinforced by carbon fiber to reduce radiant interference from electrical equipment housed in the unit and being thin walled and internally braced.

20. The unit according to claim 19 wherein the carbon fibers are arranged in layers at plus or minus forty-five degrees to improve loading characteristics.

21. The unit according to claim 18 wherein the housing further includes an outer side wall bridging between the upper surface and a bottom wall, the housing having at least two transverse bracing walls adjacent at each end of the housing, the bracing walls being interconnected by a third longitudinally extending bracing wall generally centrally disposed in the housing.

22. The unit according to claim 18 wherein the housing includes walls having an average wall thickness of 1 to 3 mm, the walls being locally strengthened in areas prone to concentrated loads.

23. The unit according to claim 18 wherein the medical equipment is located side-by-side on one side of a central bracing wall so that medical personnel need only operate from one side of the unit.

24. The unit according to claim 18 further including oxygen bottles located at opposite ends of the housing and isolated from the medical equipment.

25. The unit according to claim 18 wherein the upper surface is configured to support a stretcher, the upper surface having four stretcher feet sockets and transverse slots extending between adjacent sockets for receiving transverse stretcher braces.

26. The unit according to claim 18 wherein the housing is divided into a plurality of isolated medical equipment holders including a defibrillator holder having a drawer so that a defibrillator can be easily removed from the unit for emergency use.

27. The unit according to claim 18 wherein the housing is generally symmetrical in a side view to provide balance and including a central cavity of generally rectangular shape and the housing having tapered ends extending on opposite ends of the generally rectangular cavity.

28. The unit according to claim 18 wherein the housing is configured so that the housing can be carried in an aircraft with eight locally strengthened and evenly spaced securing points so that the unit can be either tied down or hung in stackable fashion with other similar units.

29. The unit according to claim 18 wherein the housing includes lock down means provided at an underside of the housing so that the unit can be secured to a surface such as the floor of an ambulance.

30. The unit according to claim 29 wherein the lock down means comprises a pair of skids or rails extending along the underside of the housing and equipped with spaced apertures so that a strap or other means can pass through the apertures to lock the unit in place.

31. The unit according to claim 18 wherein the housing includes brackets, holders or independent locating sites for the medical equipment so that the medical equipment is rigidly stowed yet removably secured in the housing.

32. The unit according to claim 18 wherein the housing includes a door or doors providing protection for the medical equipment from the elements or other contamination, one door being a vertically moveable curtain.

33. The unit according to claim 18 which further includes a power supply conditioner for supplying power to the equipment, firstly to the unit and then to each item of medical equipment, the power supply conditioner having a supply inlet for connection to mains or any other external power source, an input circuit receiving current from the external source, a power supply conditioner circuit and a DC output circuit providing a conditioned DC output to the medical equipment.

34. The unit according to claim 33 wherein the supply inlet is adapted to receive any one of normally available AC or DC supplies, the conditioned supply at the output being isolated from fluctuations at the input to provide a required standard DC voltage to the medical equipment.

35. The unit according to claim 33 which further includes a defibrillator having a battery enabling the defibrillator not to be connected to the power supply isolated from the power supply conditioner.

36. The unit according to claim 35 wherein the power supply conditioner is located adjacent to a vent in the housing to compensate for variations in pressure within an aircraft cabin.

37. The unit according to claim 18 wherein the unit further includes an oxygen supply circuit as well as various power supply circuits and an electrical circuit leading from a power supply conditioner to the medical equipment, the oxygen supply circuit and the electrical circuit being arranged so that oxygen supply lines and electrical cables are carried on either side of a dividing wall for safety purposes.

38. The unit according to claim 18 further including an oxygen supply circuit having at least two on board oxygen bottles, a connection for an external source of oxygen, a pneumatic circuit communicating with the bottles and the connections and oxygen supply selection means enabling selection of either of the two bottles or an external supply.

* * * * *